US011610719B2

(12) United States Patent
Yeom et al.

(10) Patent No.: US 11,610,719 B2
(45) Date of Patent: Mar. 21, 2023

(54) MAGNETIC CORE AND COIL COMPONENT COMPRISING SAME

(71) Applicant: LG INNOTEK CO., LTD., Seoul (KR)

(72) Inventors: Jai Hoon Yeom, Seoul (KR); Hyun Min Nah, Seoul (KR); Seok Bae, Seoul (KR); Sang Won Lee, Seoul (KR); Hyun Ji Lee, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 773 days.

(21) Appl. No.: 16/477,117

(22) PCT Filed: Jan. 8, 2018

(86) PCT No.: PCT/KR2018/000325
§ 371 (c)(1),
(2) Date: Jul. 10, 2019

(87) PCT Pub. No.: WO2018/131848
PCT Pub. Date: Jul. 19, 2018

(65) Prior Publication Data

US 2019/0362881 A1 Nov. 28, 2019

(30) Foreign Application Priority Data

Jan. 10, 2017 (KR) ..... 10-2017-0003614

(51) Int. Cl.
*H01F 27/24* (2006.01)
*H01F 27/255* (2006.01)
(Continued)

(52) U.S. Cl.
CPC ..... *H01F 27/255* (2013.01); *H01F 1/14741* (2013.01); *H01F 1/14766* (2013.01); *H01F 27/02* (2013.01); *H01F 27/2823* (2013.01)

(58) Field of Classification Search
CPC ..... H01F 27/255; H01F 1/14741; H01F 1/14766; H01F 27/02; H01F 27/2823;
(Continued)

(56) References Cited

U.S. PATENT DOCUMENTS 8,922,312 B2 * 12/2014 Liao ..... B22F 3/16 336/83
10,283,255 B2 * 5/2019 Yoshikawa ..... H01L 28/10
(Continued)

FOREIGN PATENT DOCUMENTS

CN 103846426 A * 6/2014 ..... H01F 1/15333
JP 2005-294458 A 10/2005
(Continued)

OTHER PUBLICATIONS

European Search Report dated Jul. 20, 2020 issued in Application No. 18738487.0.
(Continued)

*Primary Examiner* — Tuyen T Nguyen
(74) *Attorney, Agent, or Firm* — KED & Associates, LLP

(57) ABSTRACT

An embodiment provides a magnetic core comprising a first powder and a second powder, wherein the hardness of the first powder is lower than that of the second powder, and the volume of the first powder is 40% to 60% with respect to the combined volume of the first powder and the second powder.

12 Claims, 4 Drawing Sheets

(51) Int. Cl.
*H01F 1/147* (2006.01)
*H01F 27/02* (2006.01)
*H01F 27/28* (2006.01)

(58) Field of Classification Search
CPC ..... H01F 37/00; H01F 41/0246; H01F 1/22; H01F 27/24; H01F 1/015; H01F 3/08
See application file for complete search history.

(56) References Cited

U.S. PATENT DOCUMENTS

| | | | |
|---|---|---|---|
| 2010/0289609 | A1 | 11/2010 | Liao et al. |
| 2011/0272622 | A1 | 11/2011 | Wakabayashi et al. |
| 2013/0181802 | A1 | 7/2013 | Watanabe et al. |
| 2014/0138569 | A1 | 5/2014 | Otsuka et al. |
| 2014/0286814 | A1 | 9/2014 | Kotani et al. |
| 2015/0357118 | A1 | 12/2015 | Lee et al. |

FOREIGN PATENT DOCUMENTS

| | | | |
|---|---|---|---|
| JP | 2012-138494 | | 7/2012 |
| JP | 2014-107294 | A | 6/2014 |
| KR | 10-2013-0122734 | | 11/2013 |
| KR | 10-1385756 | | 4/2014 |

OTHER PUBLICATIONS

International Search Report (with English Translation) and Written Opinion dated Apr. 13, 2018 issued in Application No. PCT/KR2018/000325.

* cited by examiner

MAGNETIC CORE AND COIL COMPONENT COMPRISING SAME

CROSS-REFERENCE TO RELATED PATENT APPLICATIONS

This application is a U.S. National Stage Application under 35 U.S.C. § 371 of PCT Application No. PCT/KR2018/000325, filed Jan. 8, 2018, which claims priority to Korean Patent Application No. 10-2017-0003614, filed Jan. 10, 2017, whose entire disclosures are hereby incorporated by reference.

TECHNICAL FIELD

The present invention relates to a magnetic core and a coil component including the same.

BACKGROUND ART

High-current step-down inductors, high-current step-up inductors, three-phase line reactors, and the like for power factor corrections (PFCs) used in photovoltaic systems, wind power generation systems, electric vehicles, and the like include coils wound around magnetic cores. Since the magnetic cores included in high-current inductors or high-current reactors should improve high-current direct current (DC) bias characteristics, reduce high-frequency core loss, and obtain stable permeability, the inductances of the magnetic cores should be increased. The inductance may be defined through Equation 1.

$$L = A_L N^2 \propto \mu\left(\frac{Ae}{l_e}\right)N^2 \qquad \text{Equation 1}$$

Here, AL is an inductance of 1 Ts, N is the number of winding turns, p is permeability, A is a cross-sectional area of a core, le is a length of a magnetic path, and L is an inductance.

According to Equation 1, an inductance may be adjusted using permeability, the number of winding turns, a cross-sectional area of a core, and the like.

Meanwhile, in a case in which the material of the magnetic core has a high hardness, it is difficult to form the magnetic core. Accordingly, a binder and a lubricant are increased to improve formability, but the density of the magnetic core is decreased as contents of the binder and the lubricant are increased so that there is a limitation to inductance performance.

DISCLOSURE

Technical Problem

The present invention is directed to providing a magnetic core including heterogeneous powders.

The present invention is also directed to providing a magnetic core made by a simple process not including an assembly process.

The present invention is also directed to providing a magnetic core with improved formability.

The present invention is also directed to providing a magnetic core in which generation of a crack is reduced.

Technical Solution

One aspect of the present invention provides a magnetic core including a first powder and a second powder, wherein a hardness of the first powder is lower than that of the second powder, and a volume of the first powder ranges from 40% to 60% of a total volume of the first powder and the second powder.

The first powder may include at least one among an Fe—Si-based magnetic powder, an Fe—Ni-based magnetic powder, and an Fe-based magnetic powder.

The second powder may include at least one among an amorphous magnetic powder and a sendust alloy powder.

A Vickers hardness of the first powder may range from 100 HV to 250 HV.

A Vickers hardness of the second powder may range from 400 HV to 1000 HV.

Another aspect of the present invention provides a coil component including a magnetic core and a coil wound around the magnetic core, wherein the magnetic core includes a first powder and a second powder, a hardness of the first powder is lower than that of the second powder, and a volume of the first powder ranges from 40% to 60% of a total volume of the first powder and the second powder.

A volume of the magnetic core may range from 36% to 44% of a total volume of the coil component.

The coil component may further include a case which accommodates the magnetic core and the coil.

Advantageous Effects

According to an embodiment, a magnetic core including heterogeneous powders can be realized.

In addition, the magnetic core can be manufactured by a simple process.

In addition, the magnetic core can be manufactured in which formability is improved and generation of a crack is reduced.

A variety of useful advantages and effects are not limited to the above-described contents and will be more easily understood when specific embodiments of the present invention are described.

MODES OF THE INVENTION

Figure 1:
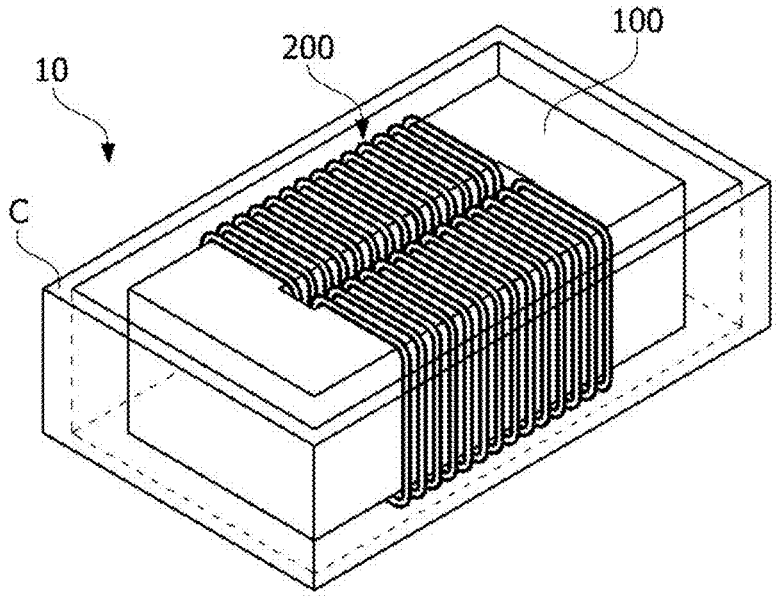
FIG. 1 is a perspective view illustrating a coil component according to an embodiment.

Since the invention allows for various changes and numerous embodiments, specific embodiments will be illustrated in the drawings and described in detail in the written description. However, this is not intended to limit the present invention to specific modes of practice, and it is to be appreciated that all changes, equivalents, and substitutes that do not depart from the spirit and technical scope of the present invention are encompassed in the present invention.

It will be understood that, although the terms "first," "second," etc. may be used herein to describe various elements, these elements should not be limited by these terms. These terms are only used to distinguish one element from another. For example, a first element could be termed a second element, and a second element could similarly be termed a first element without departing from the scope of the present invention. As used herein, the term "and/or" includes combinations or any one of a plurality of associated listed items.

It will be understood that when an element is referred to as being "connected" or "coupled" to another element, it can be directly connected or coupled to another element or intervening elements may be present. In contrast, when an element is referred to as being "directly connected" or "directly coupled" to another element, there are no intervening elements.

The terminology used herein is for the purpose of describing particular embodiments only and is not intended to be limiting to the invention. As used herein, the singular forms "a," "an," and "the" are intended to include the plural forms as well, unless the context clearly indicates otherwise. It will be further understood that the terms "comprises," "comprising," "includes," and/or "including," when used herein, specify the presence of stated features, integers, steps, operations, elements, components, and/or groups thereof but do not preclude the presence or addition of one or more other features, integers, steps, operations, elements, components, and/or groups thereof.

Unless otherwise defined, all terms including technical and scientific terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined here.

Example embodiments of the invention will be described below in more detail with reference to the accompanying drawings. Components that are the same or corresponding to each other are rendered with the same reference numeral regardless of the figure number, and redundant descriptions will be omitted.

Figure 2:
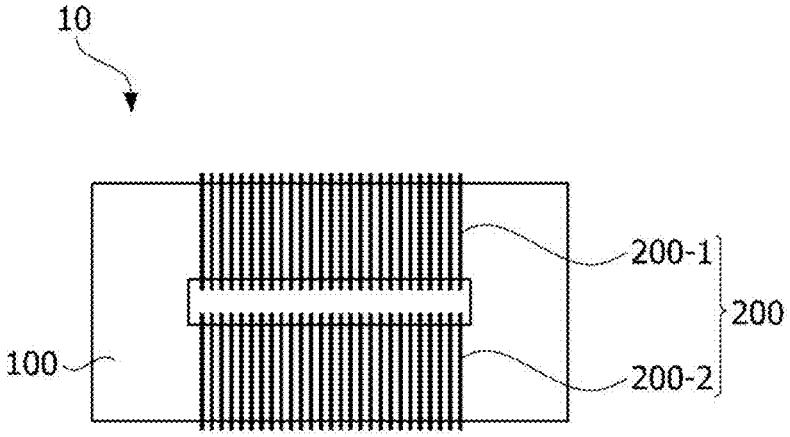
FIG. 2 is a plan view illustrating the coil component according to the embodiment.
Figure 3:
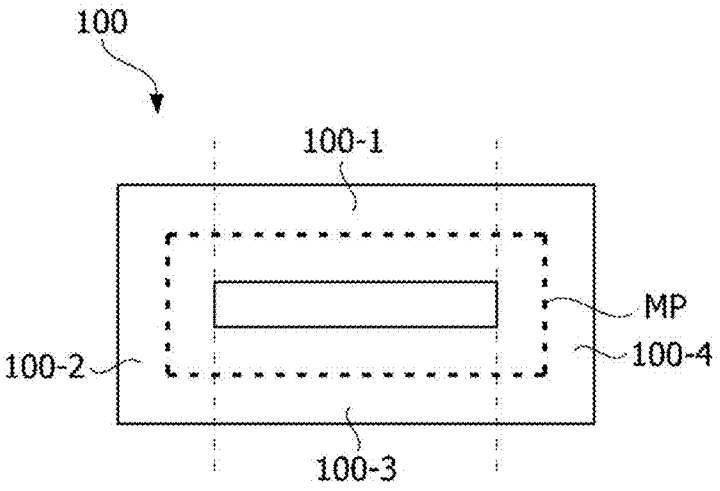
FIG. 3 is a plan view illustrating the coil component in which a coil is removed from that shown in FIG. 2.

FIG. 1 is a perspective view illustrating a coil component according to an embodiment, FIG. 2 is a plan view illustrating the coil component according to the embodiment, and FIG. 3 is a plan view illustrating the coil component in which a coil is removed from that shown in FIG. 2.

Referring to FIG. 1, a coil component 10 according to the embodiment may include a magnetic core 100, coils 200, and a case.

The magnetic core 100 may include magnetic powders. The magnetic core 100 may include a plurality of magnetic cores 100. The magnetic core 100 may be formed by assembling the magnetic cores 100 formed by pressing the magnetic powders.

The magnetic core 100 may have a doughnut shape including a hollow. However, the magnetic core 100 is not limited to such a shape. The magnetic core 100 may include a part around which the coil 200 is wound and a part around which the coil 200 is not wound.

The coil 200 may be wound around the magnetic core 100. The coil 200 may be disposed in one region of the magnetic core 100, and the coils 200 may be wound around the magnetic cores 100 which face each other.

The coil 200 may include a conductor. The conductor may include a metal such as copper or a copper alloy. The coil 200 may include an insulting layer with which the conductor is coated and which surrounds the conductor. The insulating layer may include a resin material such as enamel but is not limited thereto.

In addition, the coils 200 may be spirally wound around the magnetic cores 100 which face each other. However, the coils 200 are not limited thereto, and the coils 200 may be wound around the magnetic core 100 in various shapes such as a circular shape, an oval shape, a polygonal shape, or the like.

The case may accommodate an inductor or reactor including the magnetic core 100 and the coils 200. The case may be filled with a resin. In addition, the case may be formed of an aluminum material so as to effectively dissipate heat generated by the coil component 10. However, the material of the case is not limited thereto, and a material capable of effectively dissipating heat may be applied to the case.

Referring to FIG. 2, the coils 200 may include a first coil 200 and a second coil 200. The first coil 200 and the second coil 200 may be disposed symmetrically with respect to a hollow H of the magnetic core 100.

The first coil 200 may be connected to the second coil 200 in series. In addition, the first coil 200 and the second coil 200 may be wound the same number of winding times to have the same number of winding turns. However, the number of winding times of each of the first coil 200 and the second coil 200 is not limited thereto.

One end of the first coil 200 and one end of the second coil 200 may be connected to electrodes (not shown). In addition, the first coil 200 and the second coil 200 may be wound around one portion of each of the magnetic cores 100. In addition, bobbins (not shown) may be disposed at portions of the magnetic cores 100 around which the first coil 200 and the second coil 200 are wound. The bobbin (not shown) may be disposed between the first coil 200 and a first magnetic core 100-1. In addition, the bobbin (not shown) may be disposed between the second coil 200 and a third magnetic core 100-3.

Since a high-frequency noise is generated due to friction between the bobbin (not shown) and the magnetic core 100, an area in which the bobbin (not shown) is in contact with the magnetic core 100 may be variously adjusted according to the noise generation.

Referring to FIG. 3, the magnetic cores 100 may include a plurality of magnetic cores 100-1, 100-2, 100-3, and 100-4, and the hollow H. The magnetic cores 100 may include the first magnetic core 100-1, a second magnetic core 100-2, the third magnetic core 100-3, and a fourth magnetic core 100-4.

The first magnetic core 100-1 and the third magnetic core 100-3 may be disposed to face each other. The first magnetic core 100-1 and the third magnetic core 100-3 may be disposed symmetrically with respect to the hollow H of the magnetic core 100.

The second magnetic core 100-2 and the fourth magnetic core 100-4 may be disposed to face each other. The second magnetic core 100-2 and the fourth magnetic core 100-4 may be disposed symmetrically with respect to the hollow H of the magnetic core 100. In addition, the second magnetic core 100-2 may be disposed between the first magnetic core 100-1 and the third magnetic core 100-3. In addition, the fourth magnetic core 100-4 may be disposed between the first magnetic core 100-1 and the third magnetic core 100-3.

The coils 200 may be wound around the first magnetic core 100-1 and the third magnetic core 100-3. The first magnetic core 100-1 and the third magnetic core 100-3 may respectively include a first powder 110 and a second powder 120.

The first powder 110 may include at least one among an Fe—Si-based magnetic powder, an Fe—Ni-based magnetic powder, and an Fe-based magnetic powder. The first powder 110 may have a Vickers hardness ranging from 100 HV to 250 HV.

The hardness of the first powder 110 may be less than that of the second powder 120. The volume of the first powder 110 may range from 40% to 60% of the total volume of the first powder 110 and the second powder 120.

Preferably, the volume of the first powder 110 may range from 45% to 55% of the total volume of the first powder 110 and the second powder 120.

The second powder 120 may include at least one among an amorphous magnetic powder and a sendust alloy powder. The second powder 120 may have a Vickers hardness ranging from 400 HV to 1000 HV. The hardness of the second powder 120 may be greater than that of the first powder 110.

The first magnetic core 100-1 and the third magnetic core 100-3 may include a predetermined volume of the first powder 110 and a predetermined volume of the second powder 120.

Table 1 shows a molding pressure and a core loss according to volume ratios of the first powder 110 and the second powder 120 to the total volume of the first powder 110 and the second powder 120 in the magnetic core 100.

TABLE 1

| Comparison | Low Hardness (First Powder, Vol %) | High hardness (Second Powder, Vol %) | Molding Pressure (ton/cm$^2$) | Core Loss (mW/cc) |
|---|---|---|---|---|
| Comparative Example 1 | 0 | 100 | 24 | 400 |
| Comparative Example 2 | 20 | 80 | 22 | 420 |
| Comparative Example 3 | 30 | 70 | 20 | 440 |
| Working Example 1 | 40 | 60 | 18 | 460 |
| Working Example 2 | 45 | 55 | 17 | 480 |
| Working Example 3 | 50 | 50 | 16 | 500 |
| Working Example 4 | 55 | 45 | 16 | 520 |
| Working Example 5 | 60 | 40 | 15 | 540 |
| Comparative Example 4 | 70 | 30 | 15 | 580 |

Referring to Table 1, in the case in which the volume of the first powder 110 ranges from 40% to 60% of the total volume of the first powder 110 and the second powder 120, a molding pressure may range from 15 ton/cm2 to 18 ton/cm2.

In a case in which a molding pressure is greater than 18 ton/cm2 and a mold is filled with a powder and pressed, there is a problem in that the filled material bursts.

Accordingly, in the case of Comparative Example 1, Comparative Example 2, and Comparative Example 3, since molding pressures are high, a bursting phenomenon of the magnetic core may occur due to repulsion between second powders having a high hardness when the magnetic cores are molded.

Accordingly, in Working Examples 1 to 5, the first powder 110 may serve as a buffer between the second powders 120 during a molding process to provide a low molding pressure and reduce a repulsive force between the second powders 120 to prevent generation of a crack in the magnetic core 100. Therefore, the magnetic core 100 can be manufactured.

In addition, the magnetic core 100 may be manufactured through one instance of molding without individually manufacturing the magnetic core 100 including the first powder 110 and the magnetic core 100 including the second powder 120 and assembling the magnetic cores 100.

Therefore, since the magnetic core 100 is easily molded, for example, a magnetic path (MP) of a product of the coil 200 including an inductor may be easily increased. In addition, an intensity of a magnetic field around the magnetic core 100 may be decreased, a relatively large inductance value may be maintained when the same number of winding turns of the coil 200 and the same direct current (DC) are applied, and thus the efficiency of the product of the coil 200 can be improved.

In the case in which the volume of the first powder 110 is less than 40% of the total volume of the first powder 110 and the second powder 120 (the volume of the second powder 120 is greater than 60% thereof), since the magnetic core 100 is more similar to being amorphous, a temperature suitable for molding and thermal treatment may be decreased, a bursting phenomenon of the magnetic core occurs due to a repulsive force between the second powders 120, and thus a crack may be generated.

In addition, in the case in which the volume of the first powder 110 is greater than 60% of the total volume of the first powder 110 and the second powder 120 (the volume of the second powder 120 is less than 40% thereof), since a temperature suitable for molding and thermal treatment is increased, there is a limitation in that it is difficult to mold.

For example, in Comparative Example 4, the core loss may be 580 mW/cc. When a ratio of the first powder 110 having a low hardness is increased, a core loss in a high-frequency band is increased and an air gap of the magnetic core may be non-uniformly distributed. Accordingly, there are problems in that a leakage magnetic flux is increased, and the magnetic core is overheated.

In addition, since the first powder is more expensive than the second powder, when a ratio of the first powder to a total of the first powder and the second powder, there is also a problem in that manufacturing costs are increased.

In addition, the volume of the first magnetic core 100-1 and the third magnetic core may range from 36% to 44% of the total volume of the magnetic core 100. Accordingly, a ratio of the first powder 110 to the total volume of the magnetic core 100 may range from 14.4% to 26.4%.

The coil 200 may not be wound around the second magnetic core 100-2 and the fourth magnetic core 100-4. The second magnetic core 100-2 and the fourth magnetic core 100-4 may include at least one among an Fe—Si-based magnetic powder, an Fe—Ni-based magnetic powder, and an Fe-based magnetic powder. For example, the Fe-based magnetic powder may include at least one selected from the group consisting of an Fe—Si—B-based magnetic powder, an Fe—Ni-based magnetic powder, an Fe—Si-based magnetic powder, an Fe—Si—Al-based magnetic powder, an Fe—Ni—Mo-based magnetic powder, an Fe—Si—B-based magnetic powder, an Fe—Si—C-based magnetic powder, and an Fe—B—Si—Nb—Cu-based magnetic powder, but is not limited thereto.

In addition, an MP may be formed in the magnetic core 100, and the MP may be easily adjusted using the magnetic core 100 according to the embodiment.

Figure 4:
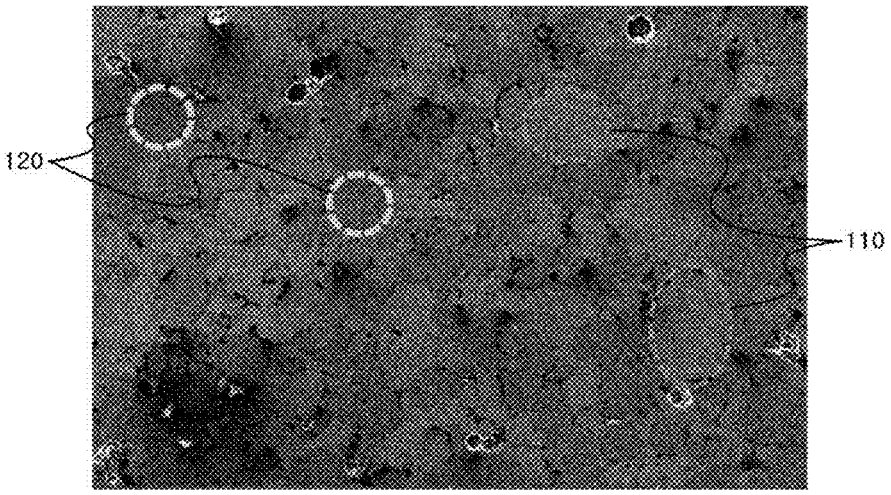
FIG. 4 is an enlarged cross-sectional view illustrating the magnetic core according to the embodiment.

FIG. 4 is an enlarged cross-sectional view illustrating the magnetic core 100 according to the embodiment, and FIGS.

5 and 6 are views for describing an effect of the coil component 10 according to the embodiment.

Referring to FIG. 4, the magnetic core 100 according to the embodiment may include the first powders 110 and the second powders 120. The first powders 110 may be disposed between the second powders 120 so as to serve as a buffer between the second powders 120.

Figure 5:
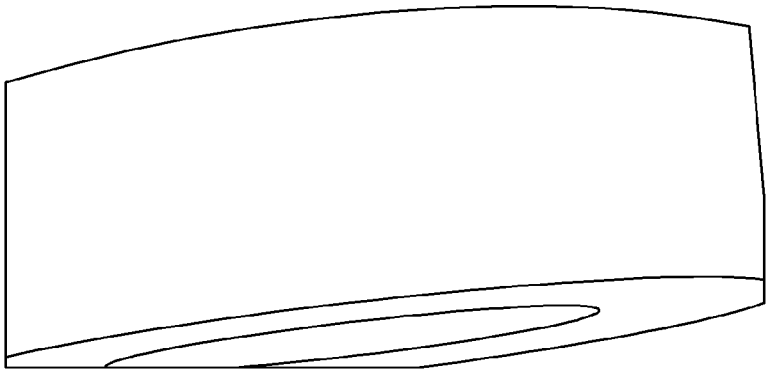
FIGS. 5 and 6 are views for describing an effect of the coil component according to the embodiment.

Referring to FIG. 5, the magnetic core 100 according to the embodiment may prevent a crack. Therefore, the magnetic core 100 may have a surface in which a crack and the like are not present.

Figure 6:
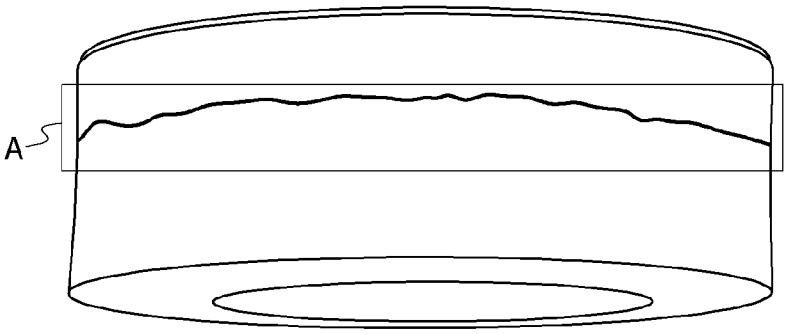

Referring to FIG. 6, in a case in which the magnetic core 100 is manufactured using the second powder 120, a breaking phenomenon of the magnetic core 100 may occur. Therefore, a crack A may be generated in the surface of the magnetic core 100. Accordingly, the reliability of the magnetic core 100 may be degraded.

In addition, since the crack degrades properties of the magnetic core 100, it may be difficult to provide desired performance of inductance and the like.

Figure 7:
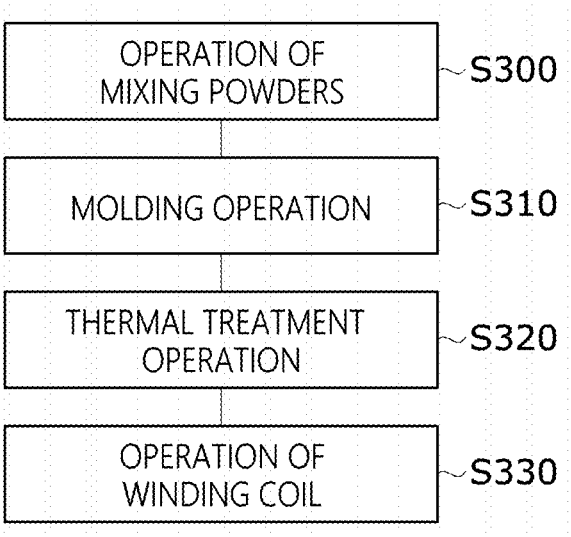
FIG. 7 is a flowchart for describing a method of manufacturing a coil component according to an embodiment.

FIG. 7 is a flowchart for describing a method of manufacturing a coil component according to an embodiment.

Referring to FIG. 7, a method of manufacturing a coil component according to the embodiment may include an operation of mixing powders (S300), a molding operation (S310), a thermal treatment operation (S320), and an operation of winding a coil (S330).

First, the powders for forming a magnetic core may be mixed (S300). The powders may include a first powder and a second powder. As illustrated above, the first powder may include at least one among an Fe—Si-based magnetic powder, an Fe—Ni-based magnetic powder, and an Fe-based magnetic powder. The first powder may have a Vickers hardness ranging from 100 HV to 250 HV. The hardness of the first powder may be less than that of the second powder.

In addition, the volume of the first powder may range from 40% to 60% of the total volume of the first powder and the second powder. Preferably, the volume of the first powder may range from 45% to 55% of the total volume of the first powder and the second powder. The above-described contents may be similarly applied to the volume thereof.

Next, the mixed powders may be bonded and supported by each other to form a required shape (S310). For example, a mold may be filled with the powders and pressed to form the magnetic core.

Here, the mold may have various shapes. Therefore, the magnetic core having various shapes may be manufactured.

In addition, the thermal treatment operation may be performed on the molded magnetic core (S320). The magnetic core molded through the thermal treatment operation is fixedly compressed to cure the mixed powder to improve the strength of a product.

In addition, a magnetic core may have a structure in which a plurality of magnetic cores are separately formed and assembled, but when the method of manufacturing according to the embodiment is used, the magnetic core may be manufactured using the mixed powders without an assembly process.

For example, the first powder and the second powder may be mixed at an appropriate ratio and a thermal treatment operation may be performed thereon to manufacture the magnetic core having a desired shape at once without assembling the magnetic cores formed using the first powder and the second powder. Due to such a configuration, since the size of the magnetic core may be easily adjusted, the performance of the coil component may also be controlled. In addition, since a manufacturing process is also simplified, manufacturing costs may be reduced.

Next, a bobbin is disposed in one portion of the magnetic core, and a coil may be wound therearound (S330). According to the embodiment, the coil may be wound around the magnetic core manufactured by the first powder and the second powder being mixed.

The coil may be coated but is not limited thereto. In addition, both ends of the coil may be connected to electrodes.

While the present invention has been mainly described above with reference to the embodiments, it will be understood by those skilled in the art that the invention is not limited to the embodiments. The embodiments are only examples, and various modifications and applications which are not illustrated above may fall within the range of the present invention without departing from the essential features of the present embodiments. For example, components specifically described in the embodiments may be modified and implemented. In addition, it should be understood that differences related to modifications and applications fall within the scope of the present invention defined by the appended claims.

The invention claimed is:

1. A magnetic core that includes a first magnetic core, a second magnetic core, a third magnetic core and a fourth magnetic core, comprising:

a first powder having a Vickers hardness greater than 100 HV and less than 250 HV; and a second powder having a Vickers hardness within a range of 400 HV to 1000 HV, wherein the hardness of the first powder is lower than the hardness of the second powder, and a volume of the first powder having the hardness greater than 100 HV ranges from 40% to 60% of a total volume of the first powder and the second powder, a volume of the first magnetic core and the third magnetic core ranges from 36% to 44% of a total volume of the magnetic core, and the volume of the first powder having the hardness greater than 100 HV ranges from 14.4% to 26.4% of the total volume of the magnetic core.

2. The magnetic core of claim 1, wherein the first powder includes at least one among an Fe—Si-based magnetic powder, an Fe—Ni-based magnetic powder, and an Fe-based magnetic powder.

3. The magnetic core of claim 1, wherein the second powder includes at least one among an amorphous magnetic powder and a sendust alloy powder.

4. A coil component comprising:

a magnetic core that includes a first magnetic core, a second magnetic core, a third magnetic core and a fourth magnetic core, the second magnetic core is disposed between the first magnetic core and the third magnetic core, and the fourth magnetic core is disposed between the first magnetic core and the third magnetic core, wherein the first magnetic core is disposed to face the third magnetic core with respect to the hollow, wherein the second magnetic core is disposed to face the fourth magnetic core with respect to the hollow; and a first coil wound around the first magnetic core and a second coil wound around the third magnetic core, wherein the magnetic core includes a first powder having a Vickers hardness greater than 100 HV and less than 250 HV and a second powder having a Vickers hardness within a range of 400 HV to 1000 HV, and the hardness of the first powder is lower than the hardness of the second powder, and a volume of the first powder having the hardness greater than 100 HV ranges from 40% to 60% of a total volume of the first powder and the second powder, a volume of the first magnetic core and the third magnetic core ranges from 36% to 44% of a total volume of the magnetic core, and the volume of the first powder having the hardness greater than 100 HV ranges from 14.4% to 26.4% of the total volume of the magnetic core.

5. The coil component of claim 4, further comprising a case which accommodates the magnetic core and the coil.

6. The coil component of claim 4, wherein the first coil and the second coil are disposed symmetrically with respect to the hollow.

7. The coil component of claim 6, wherein the first coil and the second coil are connected in series.

8. The coil component of claim 6, wherein the first coil and the second coil have the same number of winding turns.

9. The coil component of claim 4, wherein the second magnetic core is disposed to face the fourth magnetic core with respect to the hollow.

10. The coil component of claim 4, wherein the first magnetic core comprises the first powder and the second powder.

11. The coil component of claim 4, wherein the third magnetic core comprises the first powder and the second powder.

12. The coil component of claim 4, wherein the coil comprises a conductor and an insulating layer surrounding the conductor.

* * * * *